US006154907A

United States Patent [19]

Cinquin

[11] Patent Number: 6,154,907

[45] Date of Patent: Dec. 5, 2000

[54] PNEUMATIC CUSHION HAVING INDIVIDUALLY DEFORMABLE CELLS

[75] Inventor: Gérard Cinquin, Villeneuve sur Lot, France

[73] Assignee: Poly System Injection, Villeneuve sur Lot, France

[21] Appl. No.: 09/254,417

[22] PCT Filed: Jul. 20, 1998

[86] PCT No.: PCT/FR98/01582

§ 371 Date: Mar. 8, 1999

§ 102(e) Date: Mar. 8, 1999

[87] PCT Pub. No.: WO99/04673

PCT Pub. Date: Feb. 4, 1999

[30] Foreign Application Priority Data

Jul. 21, 1997 [FR] France ..... 97 09219

[51] Int. Cl.[7] ..... A47C 27/08; A61G 7/057

[52] U.S. Cl. ..... 5/713; 5/710; 5/706

[58] Field of Search ..... 5/713, 706, 709, 5/710, 655.3, 654

[56] References Cited

U.S. PATENT DOCUMENTS

| | | | |
|---|---|---|---|
| 4,542,547 | 9/1985 | Sato | 5/713 |
| 4,694,520 | 9/1987 | Paul et al. | 5/706 |
| 4,797,962 | 1/1989 | Goode | 5/713 |
| 4,833,457 | 5/1989 | Graebe, Jr. | 5/710 X |
| 4,864,671 | 9/1989 | Evans | 5/713 |
| 4,873,737 | 10/1989 | Savenije | 5/710 X |
| 4,949,412 | 8/1990 | Goode | 5/713 |
| 4,953,247 | 9/1990 | Hasty | 5/713 |
| 4,962,552 | 10/1990 | Hasty | 5/713 |
| 4,989,283 | 2/1991 | Krouskop | 5/713 |
| 4,995,124 | 2/1991 | Wridge, Jr. et al. | 5/713 X |
| 5,020,176 | 6/1991 | Dotson | 5/710 |
| 5,062,169 | 11/1991 | Kennedy et al. | 5/713 |
| 5,142,717 | 9/1992 | Everard et al. | 5/713 X |
| 5,539,942 | 7/1996 | Melou | 5/655.3 |
| 5,560,374 | 10/1996 | Viard | 5/713 |
| 5,815,864 | 10/1998 | Sloop | 5/713 X |
| 5,848,450 | 12/1998 | Oexman et al. | 5/710 X |
| 6,009,580 | 1/2000 | Caminade et al. | 5/713 |

FOREIGN PATENT DOCUMENTS

| | | | |
|---|---|---|---|
| 341570 | 11/1989 | European Pat. Off. | 5/713 |

*Primary Examiner*—Terry Lee Melius
*Assistant Examiner*—Robert G. Santos
*Attorney, Agent, or Firm*—Birch, Stewart, Kolasch & Birch, LLP

[57] ABSTRACT

The invention relates to a pneumatic cushion (1) having a base sheet (2) from which there project a plurality of adjacent inflatable cells (3) that are individually deformable in height. At least some of the cells (3) are internally fitted with respective individual sensors of cell deformation that deliver electrical signals indicating that a determined threshold of deformation of a cell (3) has been crossed.

8 Claims, 4 Drawing Sheets

PNEUMATIC CUSHION HAVING INDIVIDUALLY DEFORMABLE CELLS

The present invention relates to a pneumatic cushion having individually deformable cells for use in particular in the medical field to prevent bed sores.

BACKGROUND OF HE INVENTION

This type of cushion usually comprises a base sheet from which there project a plurality of adjacent inflatable cells that are individually adjustable in height.

When in good condition and appropriately inflated, such a cushion gives satisfaction. Nevertheless, for a patient who does not feel pain, it is not possible to determine whether the cushion is appropriately inflated. In particular, if there is a loss of pressure because a valve has been torn off, because of a puncture, etc., then the effectiveness of the cushion diminishes without the patient being aware of it.

Furthermore, it is difficult to adjust the inflation pressure of the cushion since the pressure depends on each patient and on the patient'position when installed on the cushion. The greater the weight exerted by the patient on the cushion, the greater the extent to which the cushion should be inflated.

OBJECT AND SUMMARY OF THE INVENTION

The object of the invention is to design a cushion of the above-specified type, that makes it possible detect any under- or over-inflation of the cushion and that facilitates adjusting the inflation pressure.

According to the invention, at least some of the cells are fitted internally with respective individual sensors of their deformation that deliver electric signals representative of the degree of cell deformation. Each sensor thus detects excess deformation, if any, of the cell with which it is associated. By monitoring cushion deformation instead of pressure, it is possible to monitor inflation pressure indirectly regardless of the user and the user's configuration on the cushion.

According to an advantageous characteristic of the invention, the sensor comprises an elastically compressible element disposed inside the cell to cause an electric switch to engage at a certain degree of deformation of the cell. The sensor is thus flexible and exerts no additional pressure on the user.

In a particular embodiment, the elastically compressible element is made of foam material.

The elastically compressible element is shorter in height than the cell.

The switch is disposed between the elastically compressible element and the base sheet.

In another embodiment of the sensor for sensing height deformation of the cells, the sensor comprises at least one photoelectric sensor operating in reflection to measure the deformation of the cell. The photoelectric sensor is fixed on the base sheet to emit a vertical incident light ray and to receive a vertical reflected light ray derived from the incident ray reflecting on the inside face of the top of the cell. The photoelectric cell(s) indicate(s) when two thresholds of deformation of the cell are crossed, a maximum threshold and a minimum threshold.

The sensors of the cells may advantageously be connected to an electronic processor unit which controls a compressed air feed unit connected to the cells to increase or decrease the pressure inside the cells when the sensors indicate that a maximum or a minimum threshold of deformation of the cells has been crossed. This automatically servo-controls inflation pressure to an optimum value that varies as a function of the user and of the user's position on the cushion, and that is determined by the sensors as a function of the deformation of the loaded cells.

BRIEF DESCRIPTION OF THE DRAWINGS

Other characteristics and advantages of the invention appear on reading the following description of particular embodiments given by way of non-limiting example.

Reference is made to the accompanying drawings, in which.

MORE DETAILED DESCRIPTION

Figure 1:
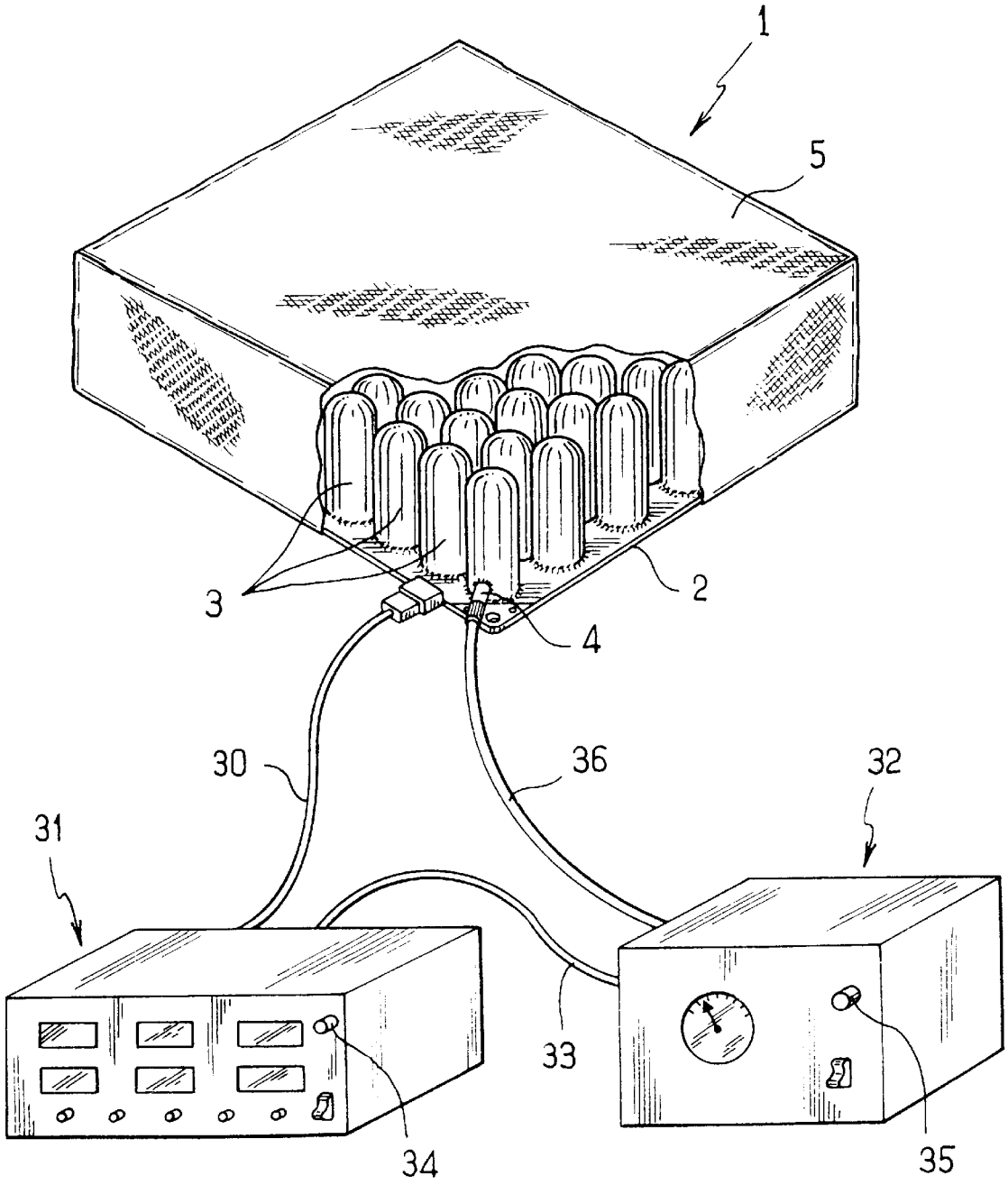
FIG. 1 is a cutaway perspective view of a pneumatic cushion of the invention.

With reference to FIG. 1, the pneumatic cushion of the invention is given overall reference 1. It comprises a base sheet 2 from which there project a plurality of mutually adjacent inflatable cells 3 that are individually deformable in height. The cells 3 define internal volumes that are designed to be put under pressure and that communicate with one another via link ducts (not shown in the figures) formed in the base sheet 2. The set of cells 3 is inflated via a single valve 4 fitted to one of the cells 3. The cells 3 can be grouped together in subsets that are inflatable independently: under such circumstances, a plurality of valves 4 are used.

The assembly constituted by the base sheet 2 and the cells 3 is contained in a cover 5 of flexible textile material.

With reference to FIGS. 2 to 5, the base sheet 2 and the cells 3 are made by superposing two layers 6 and 7 of flexible, airtight plastics material that are stuck together. The bottom layer 6 is plane and continuous while the top layer 7 forms a plurality of projections 8 constituting the outside skins of the cells 3. Each projection 8 is circularly symmetrical about an axis 9 that is substantially perpendicular to the plane of the base sheet, i.e. to the bottom layer 6, and it is substantially elongate on its axis.

Each projection 8 of the top layer 7 co-operates with the bottom layer 6 to define a pressurized inside volume which communicates via internal ducts (not shown) of the base sheet 2 with the inside volumes of the adjacent cells. As can be seen only in FIG. 1, one of the cells 3 is fitted with a valve 4 through which air under pressure is fed to all of the cells 3.

The cells 3, or at least some of them, are internally fitted with respective individual sensors 10 for sensing cell deformation along the axis 9, i.e. in the height direction, given that the cushion 1 will usually be placed on a horizontal surface. A sensor 10 comprises an elastically compressible cylindrical element 11 placed on the axis 9 and having a bottom end 11.1 stuck to an intermediate plate 12 which is itself stuck to the bottom layer 6 of the base sheet 2. By way of example, the cylinder 11 can be made of foam material.

The intermediate plate 12 has three superposed layers, comprising a bottom layer 13 stuck to the bottom layer 6 of the base sheet 2, a top layer 14 having the bottom end 11.1 of the elastically compressible cylinder 11 stuck to its top face, and an intermediate layer 15 disposed between the layers 13 and 14. In register with the elastically compressible cylinder 11, the intermediate layer 15 has a hollow 16. In this hollow 16, the layers 13 and 14 have facing faces which are fitted with facing electrical contacts 17 and 18.

The bottom layer 13 of the intermediate plate 12 may advantageously carry an integrated circuit to which the contacts 17 and 18 are connected.

Figure 2:
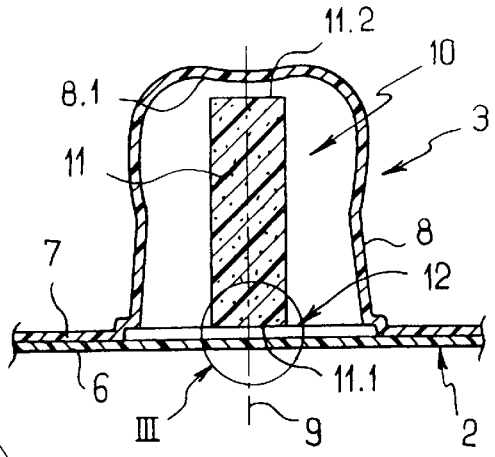
FIG. 2 is a detail section view of a cell of the FIG. 1 cushion.

As can be seen in FIG. 2, the elastically compressible cylinder 11 has a free-standing height, i.e. when unloaded, that is shorter than the height of the projection 8. In other words, the cylinder 11 has a top end 11.2 which, in the absence of any load on the cell 3, is set back from the inside face 8.1 of the top of the projection 8.

Figure 3:
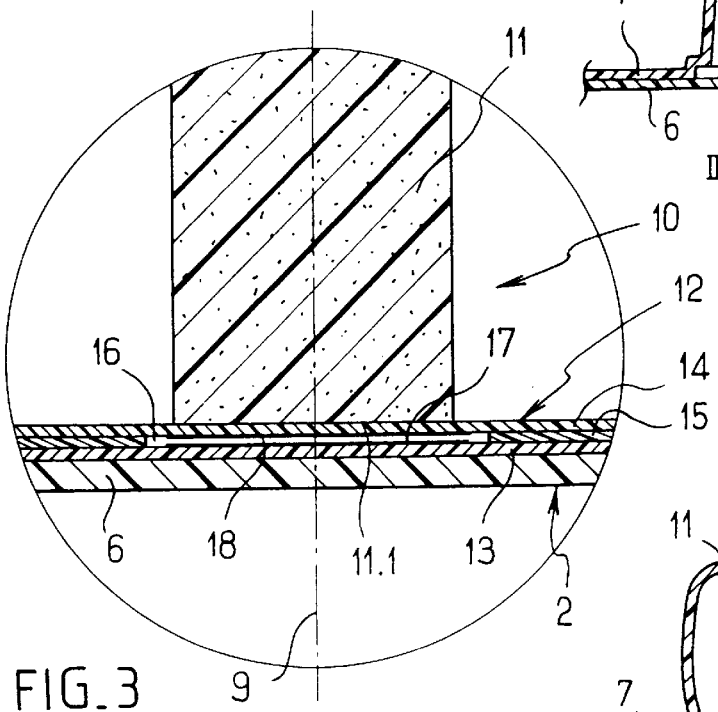
FIG. 3 is an enlarged view of zone III in FIG. 2.

In use, and when unloaded, as shown in FIGS. 2 and 3, no force is exerted on the elastically compressible cylinder 11. The electric contacts 17 and 18 are kept apart from each other by the elasticity of the top layer 14 of the intermediate plate 12.

Figure 4:
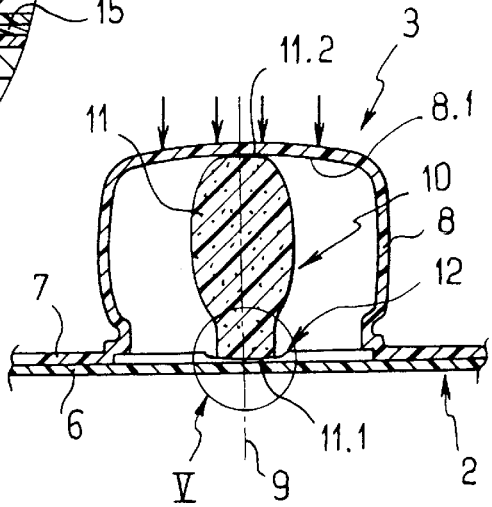
FIG. 4 is a view analogous to FIG. 3, the cell being loaded, i.e. being subjected to the weight of a user.
Figure 5:
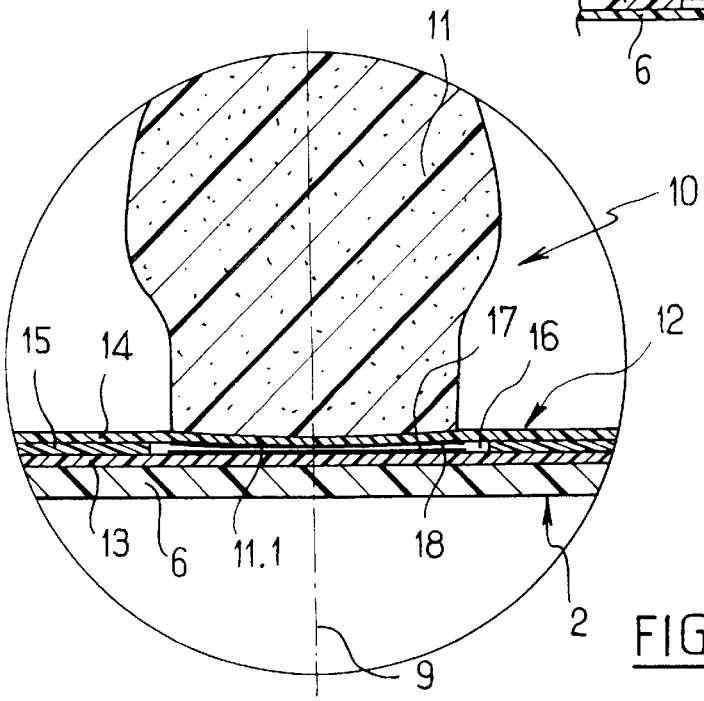
FIG. 5 is an enlarged view of zone V of FIG. 4.

Under load, as shown in FIGS. 4 and 5, the projection 8 defining each cell 3 deforms along its axis 9. If the pressure inside the cell 3 is insufficient and as a consequence the cell yields too far, the elastically compressible cylinder 11 exerts sufficient force on the switch 12 to deform the top layer 14 and press the contact 18 against the contact 17. This force exerted by the cylinder 11 on the layer 14, and by reaction on the top of the projection 8, is very small and in particular has a negligible effect on the user installed on the cushion.

When the contacts 17 and 18 come into contact, an electric signal is issued which can either cause an alarm to be triggered, or can be delivered to an electronic processor unit as in the embodiment shown in FIG. 1.

If the pressure inside the cell 3 is normal and the cell is yielding by an optimum amount, then the elastically compressible cylinder 11 is not compressed sufficiently to cause the electric contacts 17 and 18 to be put into contact, so no signal is issued.

In the embodiment shown in FIG. 1, the electric signals controlled by the switches 12 of the various cells 3 are conveyed via an electric cable 30 to an electronic processor unit 31 which, as a function of these signals, controls a compressed air feed unit 32 to which it is connected by an electric cable 33. The feed unit 32 is connected via a hose 36 to the valve 4 to feed the cells 3 with compressed air. Thus, when the cells 33 yield excessively because of insufficient pressure, the unit 31 receives the electric signals issued by the deformation sensors 10 and causes the feed unit 32 to increase the pressure inside the cells 3. Once the proper pressure has been reached, the sensors 10 cease to issue their signals and the electronic processor unit 31 interrupts inflation of the cells 3 by the feed unit 32.

Conversely, when there is a danger of the pressure inside the cells 3 becoming too high, it is possible to act either directly on the valve 4 or indirectly on buttons 34 or 35 of the control unit or of the feed unit to cause the pressure inside the cells 3 to drop until the sensors 10 issue their signals indicating that the optimum deformation threshold of the inflatable cells 3 have been reached. The electronic processor unit 31 then controls the feeder unit 32 to adjust the pressure automatically to slightly above this threshold.

Figure 6:
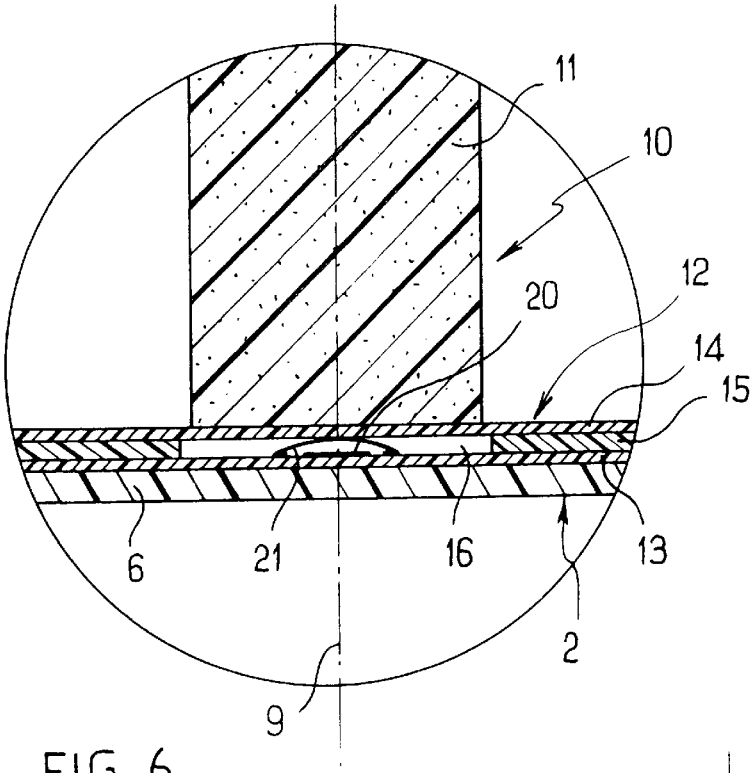
FIGS. 6 and 7 are views analogous to FIGS. 3 and 5 respectively, showing another embodiment of the electrical contacts of the sensor.
Figure 7:
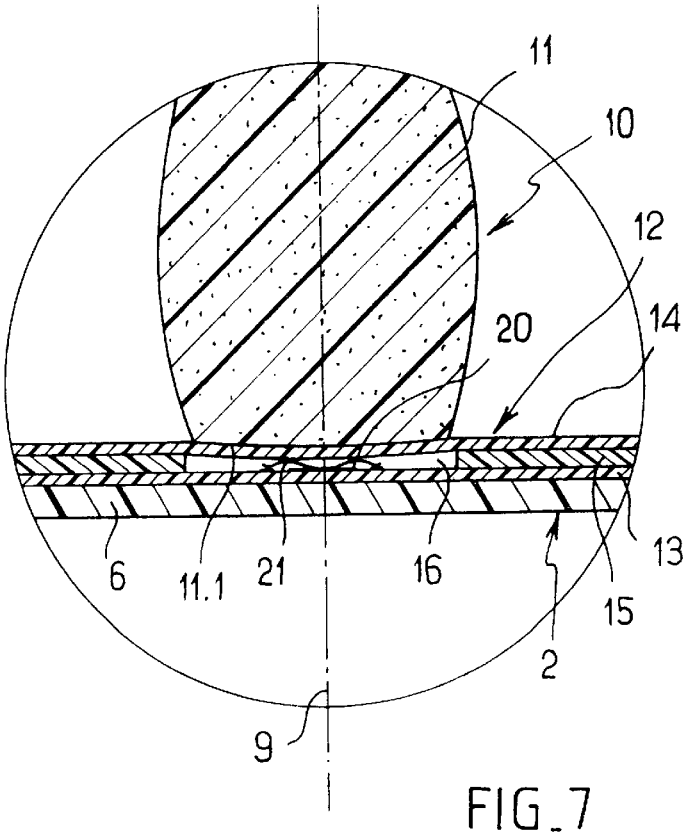

FIGS. 6 and 7 show a variant embodiment for the electrical contacts of the switch 12 of a sensor 10. In this case, the contacts are constituted by a first contact 20 which is flat and placed on the top face of the bottom layer 13, and by a second contact 21 which is curved, having two ends secured to the top face of the bottom layer 13. As before, the contacts 20 and 21 are connected to integrated circuits of the bottom layer 13.

When the cell yields too much, as shown in FIG. 7, the elastically compressible cylinder 11 deforms the top layer 14 and the contact 21. The contact 21 snaps into a corrugated shape ensuring clean contact with the contact 20.

Figure 8:
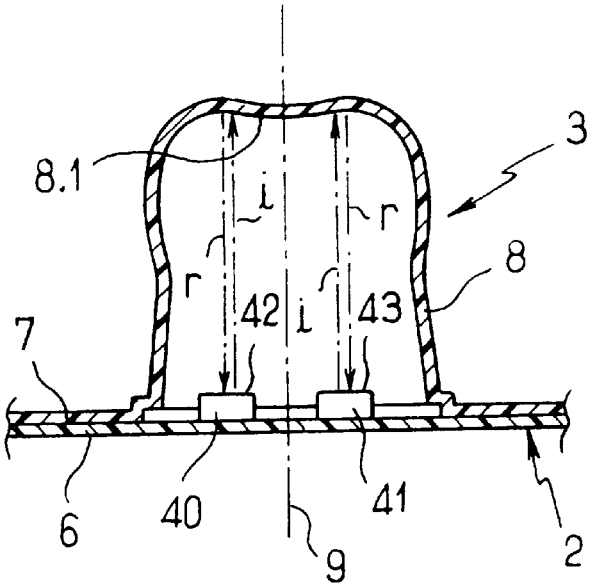
FIGS. 8 and 9 are views analogous to FIGS. 2 and 4 respectively, showing another embodiment of the sensor for sensing height deformation of the cells.
Figure 9:
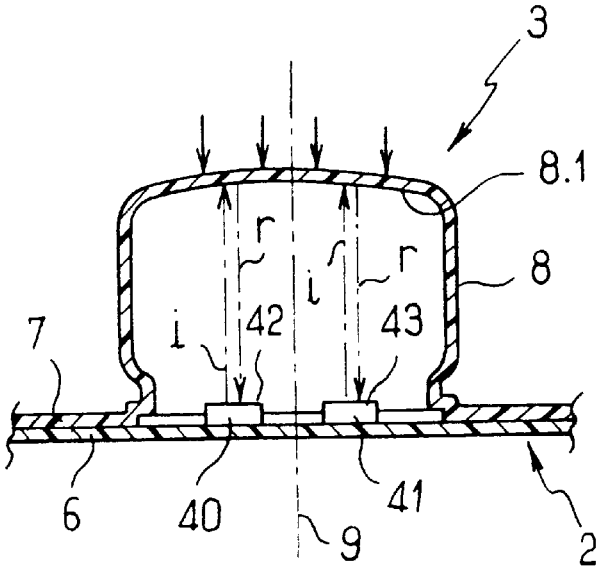

FIGS. 8 and 9 show another embodiment of the sensor for sensing height deformation of a cell 3. In this case the sensor comprises two photoelectric sensors 40 and 41 working by reflection, and disposed to measure deformation of the cell 3. Each of the sensors 40 and 41 is fixed to the base sheet 2, i.e., more specifically, to the bottom layer 6 inside the cell 3, and it has its active face 42 and 43 pointing upwards, i.e. towards the top of the projection 8 forming the cell 3.

Each sensor emits a vertical incident light ray i which illuminates the inside face 8.1 of the top of the projection 8 and which is reflected by said surface as a reflected light way r which is received by the corresponding sensor. When the color of the material from which the projection 8 is made is not too dark, there is no need to place any kind of element on the inside face 8.1 of the top of the projection 8 to reflect the incident light ray i. However if the color of the inside face 8.1 of the projection 8 is dark (e.g. black) it may be necessary to fit said surface with a reflecting plate or coating to act as a mirror.

Each sensor 40 and 41 is suitable for delivering an electric signal indicating that the height deformation of the cell 3 has crossed a certain threshold. In particular, the sensor 40 can indicate that a maximum deformation threshold has been crossed, performing the same function as the elastically compressible sensor described above with reference to FIGS. 2 to 7, while the second sensor 41 can perform an additional function which consists in indicating when a minimum deformation threshold is crossed. The sensors 40 and 41 thus respectively indicate when the cell 3 is under-inflated and when it is over-inflated. Naturally each of these two thresholds could be adjustable.

The invention is not limited to the embodiments described above, but on the contrary covers any variant using equivalent means to reproduce its essential characteristics.

For example, although a sensor is described comprising an elastically compressible cylinder of height that is smaller than the height of the cells, it is also possible to provide for the elastically compressible element, even when unloaded, to be in contact with the top of the projection defining the cell. All that matters is the threshold of cell deformation from which the compressible element acts sufficiently on the electric switch to put its contacts into contact with each other, which threshold defines the maximum value for cell deformation.

Although a deformation sensor has been described that comprises two photoelectric sensors each dedicated to indicating when a particular deformation threshold is crossed, namely a maximum threshold and a minimum threshold, it is also possible to use a single photoelectric cell indicating when a single threshold is crossed, namely a maximum threshold, or indicating both a maximum threshold and a minimum threshold by using associated measurement electronics.

What is claimed is:

1. A pneumatic cushion comprising a base sheet, a plurality of adjacent inflatable cells projecting from said base sheet and individually deformable in height, at least some of said cells being internally provided with respective individual sensors for sensing deformation thereof and each delivering an electrical signal indicative of said deformation wherein each sensor comprises a switch located on the base sheet and having electrical contacts normally and elastically kept apart from each other and an elastically compressible element inside the cell above said switch and causing said electrical contacts to engage at a certain degree of deformation of the cell.

2. A cushion according to claim 1, wherein said compressible element is made of foam material.

3. A cushion according to claim 2, wherein the elastically compressible element is shorter in height than the cell.

4. A cushion according to claim 1, wherein said switch is integrated in an intermediate plate stuck to a face of said bottom sheet inside said cell.

5. A cushion according to claim 4, wherein said intermediate plate is made of three superposed layers, with an intermediate layer having a hole through which the two external layers may move each relative to the other under the pressure of said elastically compressible member.

6. A cushion according to claim 5, wherein said external layers have facing surfaces registered with said hole fitted with said electrical contacts.

7. A cushion according to claim 5, wherein one of said electrical contacts is flat and placed, in said hole, on the top face of the external bottom layer and the other of said electrical contacts is, in said hole, normally curved and secured to the top face of said external bottom layer by two ends thereof in order to snap into a corrugated shape under the pressure of said elastically compressible element.

8. A cushion according to claim 1, wherein the sensors of the cells are connected to an electronic processor unit which controls a compressed air feed unit connected to the cells to increase or decrease the pressure inside the cells when the sensors indicate that a maximum or a minimum threshold of deformation of the cells has been crossed.

* * * * *